United States Patent [19]

Spencer

[11] 4,015,724

[45] Apr. 5, 1977

[54] METHOD AND APPARATUS FOR HANDLING SUBSTACKS OF BUSINESS FORMS TO DEVELOP BALANCED STACKS

[75] Inventor: Harvey J. Spencer, Green Bay, Wis.

[73] Assignee: Paper Converting Machine Company, Green Bay, Wis.

[22] Filed: Aug. 21, 1975

[21] Appl. No.: 606,650

[52] U.S. Cl. ..... 214/6.5; 53/142; 214/6 H

[51] Int. Cl.² ..... B65G 57/16

[58] Field of Search ..... 214/6 H, 6.5, 152; 53/142, 143; 93/93 DP

[56] References Cited

UNITED STATES PATENTS

| | | | |
|---|---|---|---|
| 2,141,483 | 12/1938 | Parker | 214/6.5 X |
| 3,166,206 | 1/1965 | Porter et al. | 214/6.5 X |
| 3,379,320 | 4/1968 | Loach et al. | 214/6.5 |
| 3,404,609 | 10/1968 | Hartbauer et al. | 214/6.5 X |
| 3,567,046 | 3/1971 | Reist | 214/6 H X |
| 3,631,770 | 1/1972 | Kratzert et al. | 93/93 DP |
| 3,851,773 | 12/1974 | Kluge et al. | 214/6.5 |

*Primary Examiner*—L. J. Paperner
*Attorney, Agent, or Firm*—Tilton, Fallon, Lungmus, Chestnut & Hill

[57] ABSTRACT

Method and apparatus for handling substacks of business forms to develop balanced stacks for packing wherein alternate substacks are rotated 90° incident to the formation of a stack whereby the glued edges are alternately reversed.

3 Claims, 10 Drawing Figures

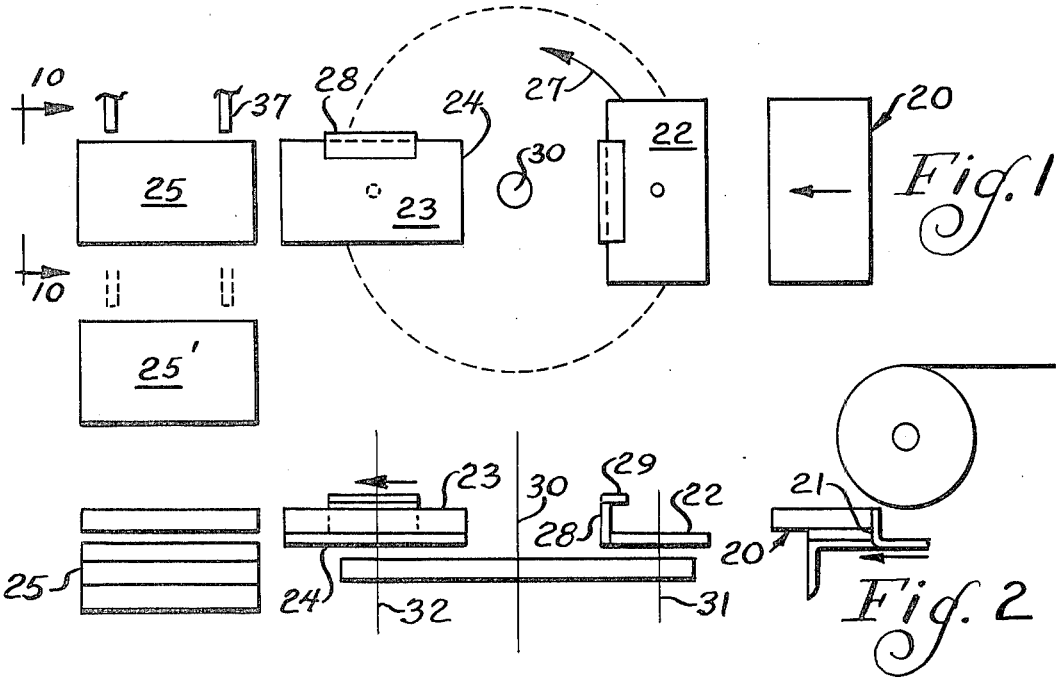
Fig. 1
Fig. 2
Fig. 3
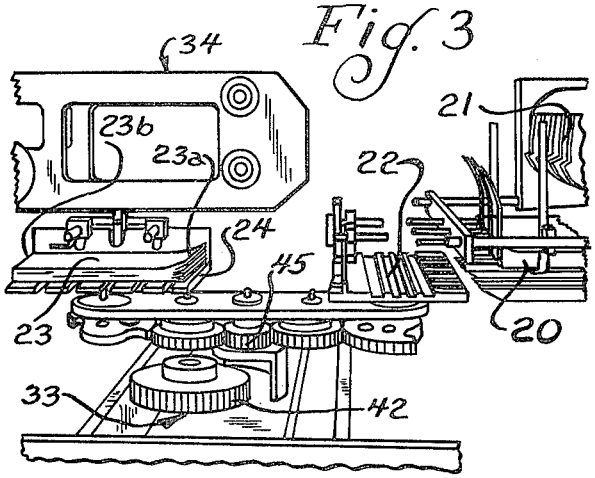
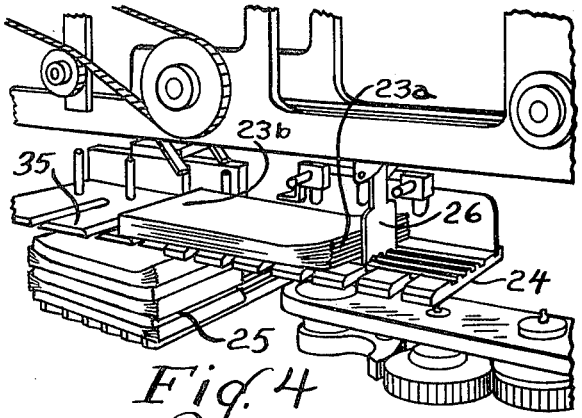
Fig. 4
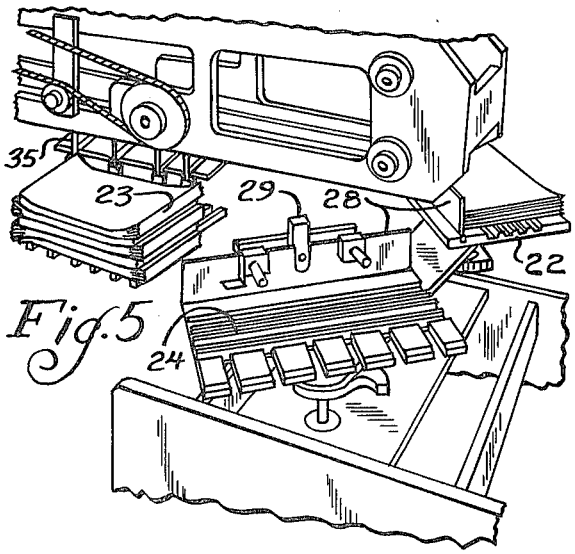
Fig. 5
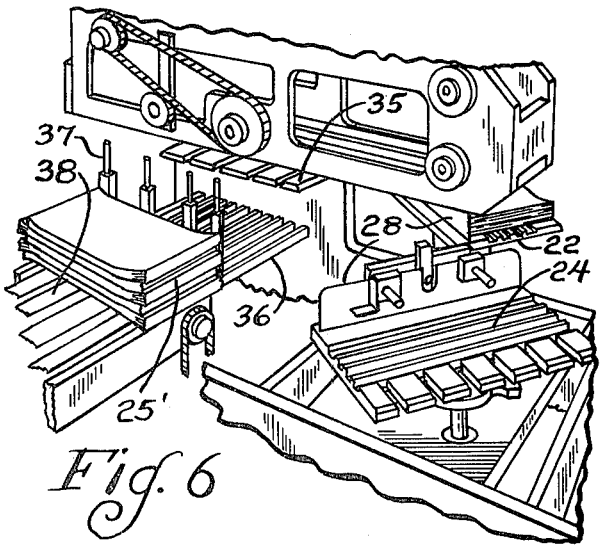
Fig. 6

Fig. 7
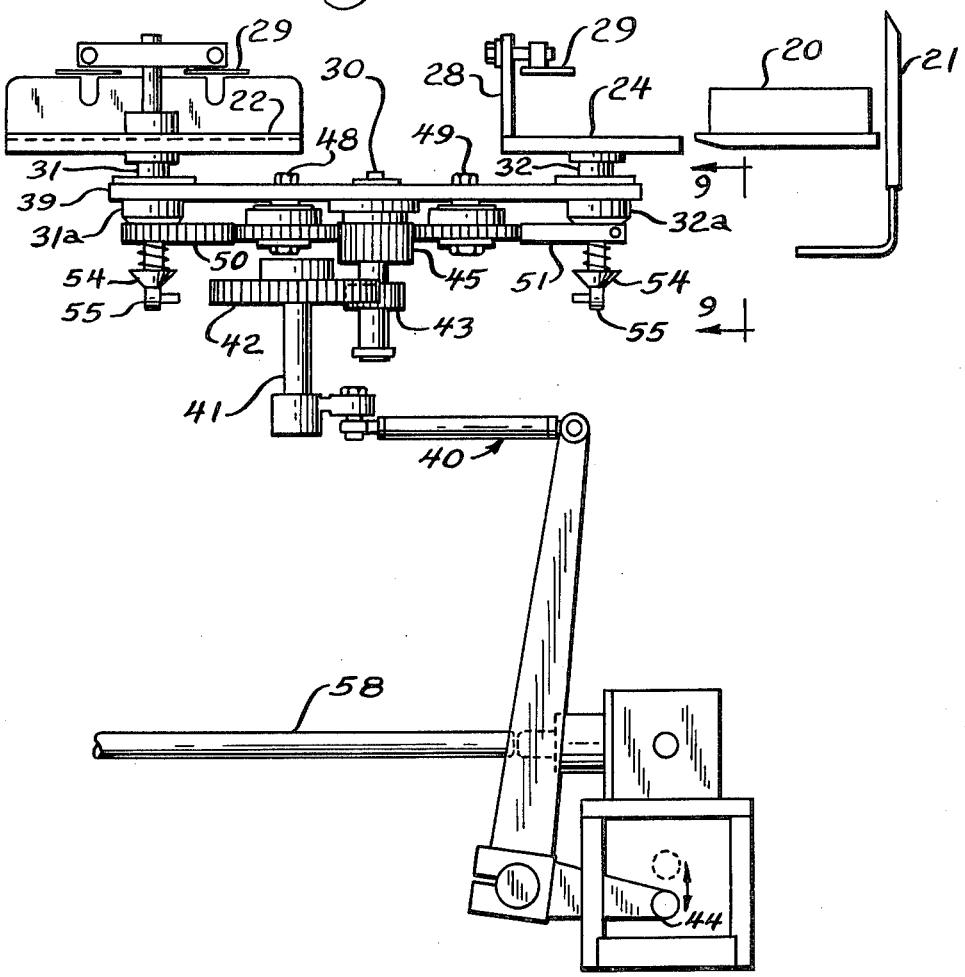
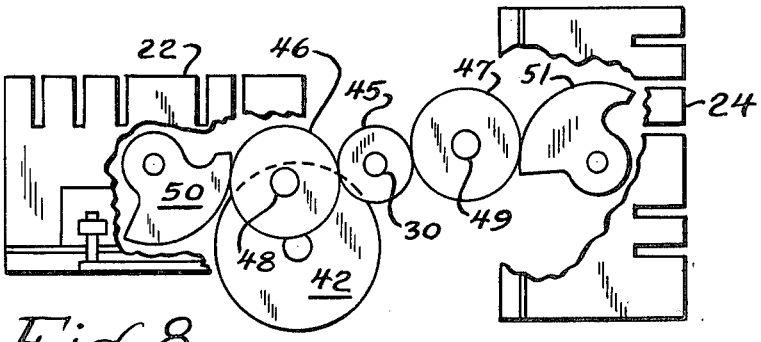
Fig. 8
Fig. 9
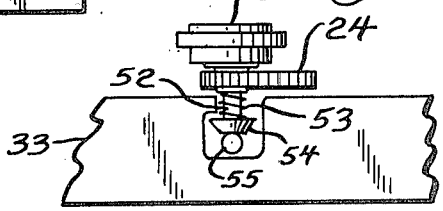

METHOD AND APPARATUS FOR HANDLING SUBSTACKS OF BUSINESS FORMS TO DEVELOP BALANCED STACKS

BACKGROUND AND SUMMARY OF INVENTION

This invention has to do with the handling of substacks of business forms which accumulate into stacks and, more particularly, to a method and apparatus of handling substacks wherein alternate substacks are rotated 90° in order to develop a balanced stack.

This invention is an improvement upon Spencer and Nystrand U.S. Pat. No. 3,599,805. The above-mentioned U.S. Pat. No. 3,599,805 dealt with a machine for producing business forms and featured apparatus which flipped each business form or "unit set" as it issued from the machine so that when the forms are consecutively numbered, they will be developed into a stack where the lowest numbered form is at the base of the stack with its facing sheet faced down. Other apparatus in the U.S. Pat. No. 3,599,805 disclosure assisted in the development of "square" stacks. The output of the apparatus of the U.S. Pat. No. 3,599,805 a series of square stacks numbering, for example, 50 unit sets in each stack. The instant invention carries on from where the disclosure of the U.S. Pat. No. 3,599,805 leaves off, i.e., taking the stacks of 50, for example, (hereinafter designated "substacks") and accumulating them into larger stacks of say 200 or 250 unit sets. To this end, a novel method and apparatus is employed wherein alternate substacks in the series are rotated 90° in one direction while the remaining alternate stacks are rotated 90° in the other direction whereby a master stack can be accumulated having glued edges balanced on each side so as to avoid a sloping stack.

DETAILED DESCRIPTION OF THE INVENTION

The invention is described in conjunction with the accompanying drawing, in which FIG. 1 is a plan schematic view of the apparatus employed in conjunction with the invention to assist in explanation of the inventive method;

FIG. 2 is a schematic elevational view of the apparatus of FIG. 1;

FIG. 3 is a fragmentary perspective view of the apparatus of FIGS. 1 and 2 showing the transfer apparatus in a position to advance a substack into a previously accumulated partial stack;

FIG. 4 is a view similar to FIG. 3 but showing the apparatus as it is oriented later, showing a substack in the process of being pushed onto a previously accumulated partial stack;

FIG. 5 is a view similar to FIGS. 3 and 4 but showing the apparatus later in the operational sequence, i.e., showing the reversal of the substack carrying platform;

FIG. 6 is a view similar to FIGS. 3–5 of the apparatus in the condition it assumes momentarily after the showing in FIG. 5 and wherein a completed stack is being removed from the stack accumulating station;

FIG. 7 is a fragmentary elevational view, partially in section of the mechanical elements of the machine corresponding essentially to the schematic representation in FIG. 2;

FIG. 8 is a fragmentary top plan view showing machine elements and corresponding essentially to the schematic showing in FIG. 1;

FIG. 9 is a fragmentary elevational view of a portion of the apparatus for deactivating the clamping means and corresponds to that portion of the machine which would be seen along the sight line 9—9 applied to FIG. 7.

Figure 10:
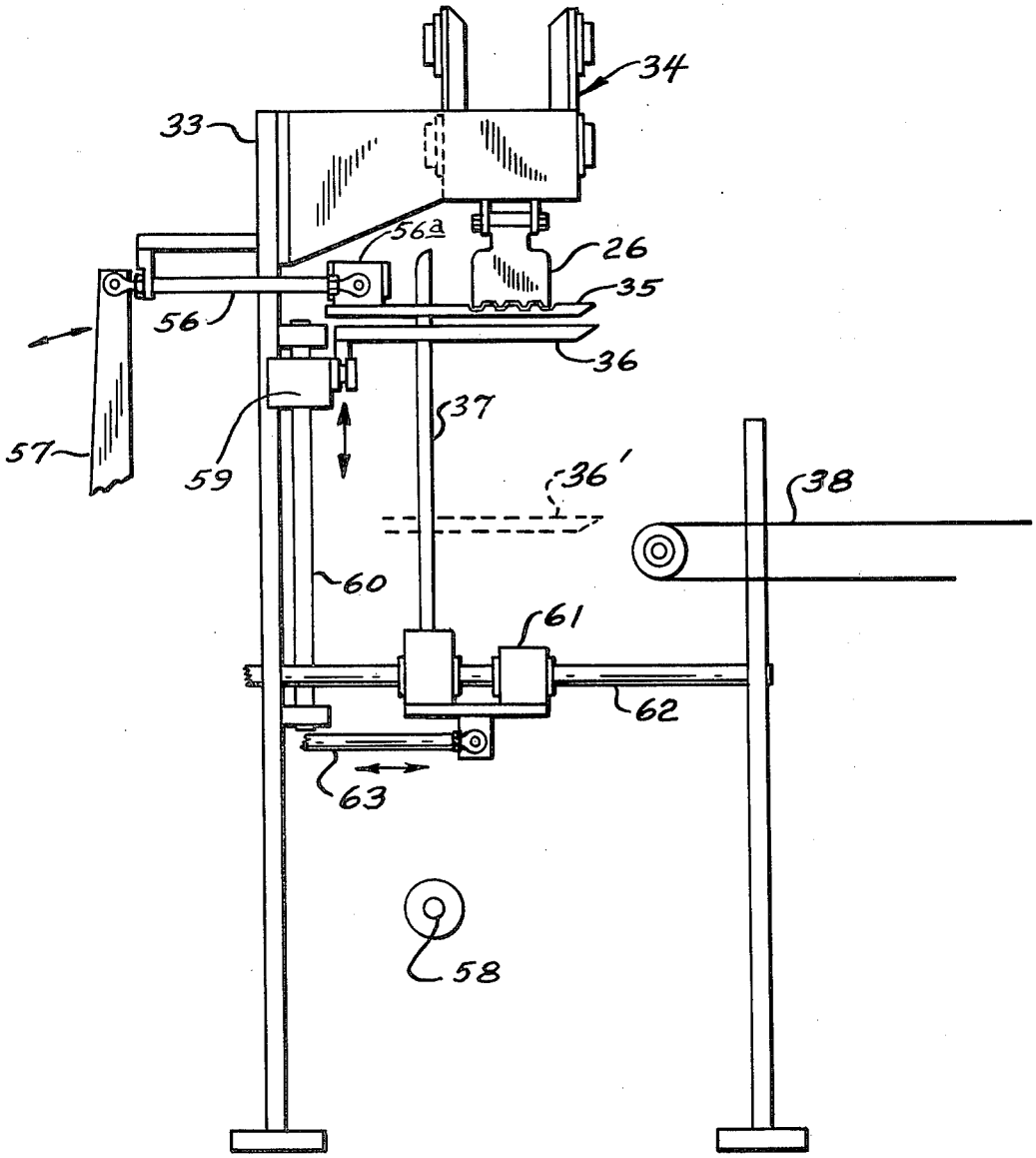
FIG. 10 is a fragmentary end elevational view such as would be seen along the sight line 10—10 applied to FIG. 1.

In the illustration given and with reference to FIGS. 1–3, the numeral 20 designates a substack which has been assembled at the end of a delivery path according to the teachings of co-owned U.S. Pat. No. 3,599,805. After a predetermined number of business forms have been assembled into the substack 20, a pusher mechanism 21 (see the right hand portions of FIGS. 2 and 3) advances the substack 20 onto a platform 22. While this is occurring a previous substack 23 (again compare FIGS. 2 and 3 but at the left hand portions thereof) is about to be pushed from the platform 24 onto a previously accumulated partial stack 25 (see the left hand portion of FIG. 4). In FIG. 4, it is seen that a pusher 26 has pushed the substack 23 part way off of the platform 24.

From a consideration of FIGS. 3 and 4, it will be noted that the right end 23*a* of the stack 23 bulks higher than the left hand end 23*b* — this stemming from the fact that the right hand end of the stack 23 is the edge carrying the glue strips to secure the various sheets within each business form or unit set. The object of the invention is to reverse alternate substacks so that the stack resulting from an accumulation of four or more substacks will not slope, i.e., be substantially higher along one edge than the other. Heretofore, the reversal, if performed at all, was done manually which required arduous pivoting movements on the part of the worker and attended to upset the desired squareness besides requiring concentration on which way a given substack was to be turned.

I have avoided the difficulties previously inherent in the manual stacking operation through the use of the platforms 22 and 24 programmed to revolve through an arc of 180° while rotating 90°, i.e., there is a retrograde movement of 90° while a substack is swung through 180°. Thus, in the next cycle, the platform 22 (see FIG. 1) will be revolved 180° in a counterclockwise direction — see the arrow designated 27. This is seen in an operational version of the inventive machine in FIG. 5 where the platform 22 has been revolved 90° — during which time it has rotated 45°. The platform 24 (still referring to FIG. 5) is empty and further operation of the machine will bring it into the loading position, i.e., into the position occupied by the platform 22 in FIG. 3.

Each platform 22 and 24 (still referring to FIG. 5) is equipped with an abutment 28, along one platform side, which serves to stop and square the substack when it is pushed onto the platform by the pusher mechanism 21. The abutment 28 also supports a resilient clamping device 29. The clamping device is selectively deenergized during loading and unloading so as to permit free movement of the substack onto and off of the associated platform but is active during the revolution-rotation of each platform to prevent inadvertent and undesired flutter or even shift of the unit sets within each substack.

As can be appreciated from a consideration of FIG. 1, the abutment 28 associated with the platform 24 is positioned along one side of the machine. In contrast to this, the abutment 28 associated with the platform 22 will be along the platform side adjacent the other side of the machine when the platform 22 is in the unloading position, i.e., adjacent the stack 25. This can be appreciated from a consideration of FIG. 6 where the platform 22 is approaching the unloading position.

During the next cycle, the platform 24, after being loaded will be revolved clockwise so that it will assume the position designated 24 in FIG. 1 when it is in the unloading position. Thus each platform oscillates through a 180° arc around the axis of the main shaft 30 and while so doing oscillates 90° about the axis of its own shaft: 31 and 32 for the platforms 22 and 24, respectively. This results in the stacks being delivered with the glued edges facing one direction during one delivery and the glued edges of the next substack facing the opposite direction. For this purpose, the shaft 30 is suitably journalled within the machine frame generally designated 33 (see FIG. 3) and is oscillated 180° in one direction and thereafter 180° in the other direction through a cam actuated linkage to be described hereinafter with respect to FIGS. 7 and 8.

As each platform 22 or 24 moves into the unloading position, a pusher mechanism generally designated 34 advances a pusher (as at 26 in FIG. 4) to advance a substack onto a receiving plate 35 (still referring to FIG. 4). The receiving plate 35 is mounted for reciprocation in a horizontal plane and is retractable (see FIG. 5) to deposit a substack 23 on a previous accumulation of substacks — as at 25 in FIG. 4. The partial stack or accumulation of substacks 25 is supported on elevator fingers 36 (best seen in FIG. 6). After the requisite number of substacks have been accumulated into a master stack 25' (still referring to FIG. 6), pusher fingers 37 move horizontally to move the stack 25' onto a takeaway conveyor 38 which leads into an automatic packaging machine (not shown).

Turning now to the second sheet of the drawing, and with particular reference to FIGS. 7 and 8, it will be seen that the mechanical elements are in an orientation somewhat later in the cyclic operation than those seen in FIG. 6, i.e., platform 24 has moved into the loading position while platform 22 has moved to the unloading position. In the central portion of each of these views, the main shaft 30 is again designated but for the sake of clearness of presentation and ease of understanding, many of the machine elements such as the frame have been omitted. The main shaft 30 has affixed to it (see FIG. 7) a support member 39 which carries the platforms 22 and 24. More particularly, the support member 39 provides a mounting for the vertical shaft 32 associated with the platform 24 and the vertical shaft 31 associated with the platform 22. Suitable bearings as at 31*a* and 32*a* are provided in the support member 39 for this purpose.

The shaft 30 and therefore the support member 39 are oscillated over a 180° arc by means of a cam actuated crank and rocker arm system generally designated 40 and seen in the lower portion of FIG. 7. More particularly, the output of the system 40 is delivered to a vertical shaft 41 which is suitably journalled in the machine frame and has affixed to it a spur gear 42. The spur gear 42 can also be seen in the lower left hand portion of FIG. 3. The gear 42 engages a mating spur gear 43 on the main shaft 30. Thus, as the cam follower 44 (see the central bottom of FIG. 7) oscillates over a small arc in following a cam (not shown), the system 40 delivers a crank or eccentric motion to the shaft 41 which in turn by a step-up ration of gears turns the shaft 180° in one direction and thereafter in the opposite direction.

Meanwhile, the platforms 22 and 24 rotate about their own shafts 31 and 32 only 90° relative to the support member 39. The gear train for this purpose can be seen best in FIG. 8. There, the numeral 45 designates a gear fixed to the frame 33 which engages gears 46 and 47 mounted on shafts 48 and 49, respectively. The shafts 48 and 49 are again, suitably journalled in the support member 39 as can be appreciated from a consideration of FIG. 7.The gears 48 and 49 engage respectively sector gears 50 and 51 which are mounted on the shafts 31 and 32. The portion of the gear train associated with the platform 22 can be seen in perspective view in FIG. 3. Thus, the gear trains 46, 50 and 47, 51 move in planetary fashion around fixed gear 45.

The means for deactivating the resilient clamping means 29 can be best appreciated from a consideration of FIG. 9. There the platform 24 is seen equipped with a vertical shaft 52 which is reciprocably mounted therein and spring-loaded as at 53 to urge the clamping device downwardly to compress a substack against the platform 24. At its lower end, the shaft 52 is equipped with a frusto conical element 54 (see also FIG. 7) which comes into engagement with an abutment roller 55 whenever the associated platform 22 or 24 is in the loading or unloading position. The engagement of the frusto conical element 54 with the abutment roller 55 compresses the spring 53 and moves the shaft 52 upwardly and hence, deactivates the clamping device 29.

Reference is now made to FIG. 10 which again omits a good portion of the machine elements for the sake of clearness and simplicity. The view in FIG. 10 is taken looking upstream, i.e., from the left to the right hand side of FIG. 1. In the upper portion of the view in FIG. 10, the pusher 26 is seen supported on the pusher mechanism 34 which in turn is carried by the machine frame 33. Also carried by the machine frame 33 is a rod 56 which is connected by means of a block 56*a* to the retractable plate 35. The plate 35 receives the substacks sequentially and after the same have been deposited thereon, is retracted by means of a cam activated rocker arm 57. The rocker arm 57 is actuated through intermediate mechanism, not shown, by means of a cam (also not shown) on a line shaft 58 (see the central bottom of FIG. 10). The line shaft 58 makes one revolution for each substack 20 being produced by the main business form machine, i.e., being synchronized with the pusher 21 (see FIG. 2).

Referring again to FIG. 10, the numeral 36 designates a plurality of elevator fingers which have been previously referred to in connection with FIG. 6. The elevator fingers 36 are mounted for movement vertically from an uppermost position shown in solid line in FIG. 10 and designated 36 to a lowermost position designated 36'. The movement of the elevator fingers 36 is achieved through reciprocating a block 59 which is slidably mounted on a shaft 60 suitably fixed to the frame 33. By suitable mechanism (not shown), the fingers 36 are stepped downwardly during the accumulation of a stack and after a predetermined number of substacks have been accumulated into a stack, the elevator fingers 36 are moved to the 36' position wherein they are aligned with the takeaway or delivery conveyor 38.

At this time the stack pusher fingers 37 (also seen in FIG. 6) are moved to the right in FIG. 10, being mounted in a block 61 which is slidably mounted on shafts 62 and actuated by means of a pusher arm 63.

OPERATION

According to the invention substacks having a predetermined number of forms such as 20 are manipulated to form balanced stacks 25' each having an integral number of substacks — starting with business forms being assembled into substacks 20 at the end of a delivery path. Each substack 20 is advanced by a pusher 21 sequentially onto platforms 22 and 24 — the platforms 24 rotating 90° in opposite directions while travelling 180° to a discharge or unloading position — onto plate 35. By selectively retracting the plate 35, each substack is deposited on a partially accumulated stack 25 — but with the glued edges of each substack on opposite sides in going from one substack to the next adjacent substack. Thereafter, the stack 25' is pushed horizontally (FIG. 6) by fingers 37 onto a discharge conveyor for packaging.

I claim:

1. Apparatus for handling substacks of business forms to develop balanced stacks for packing comprising:

a frame, means on said frame for assembling forms at the end of a delivery path into a series of substacks each having a predetermined number of forms therein, means on said frame for rotating alternate substacks 90° in one direction and for rotating the other alternate substacks 90° in the opposite direction, pusher means on said frame for advancing the rotated substacks into a stacking station, said rotating means including a shaft having a vertical axis and a relatively elongated support member at the top thereof, means operably associated with said shaft for oscillating the same 180° in opposite directions to alternately place one end of said support member adjacent said assembling means while the other end is adjacent said stacking station, two platforms rotatably mounted on said support member, one for each end thereof, and drive means for each platform for rotating the same 90° for each 180° of rotation of said shaft, and means on said frame responsive to the accumulation of a predetermined number of substacks in said stacking station for moving a stack of forms into a packaging station.

2. The structure of claim 1 in which each platform is affixed to a vertical shaft journalled in said support member, and a gear train coupling each vertical shaft with said rotating means shaft.

3. The structure of claim 1 in which each platform has a clamping device mounted thereon adjacent one platform side, each platform being so oriented to place said one platform side transversely to said path when said platform is adjacent said assembling means and with said one platform side and clamping device being remote from said assembling means to permit a substack of forms to be pushed onto said platform, each platform also being so oriented to place said one platform side parallel to said path when adjacent said stacking station to permit a substack of forms to be pushed off said platform, and means operably associated with said frame for deactivating said clamping device during pushing of a substack onto and off of said platform.

* * * * *